US006626716B1

(12) United States Patent
Peng

(10) Patent No.: US 6,626,716 B1
(45) Date of Patent: Sep. 30, 2003

(54) FIXING STRUCTURE OF PADDLE

(76) Inventor: I-Sin Peng, 235 Chung-Ho, Box 8-24, Taipei (TW)

( * ) Notice: Subject to any disclaimer, the term of this patent is extended or adjusted under 35 U.S.C. 154(b) by 0 days.

(21) Appl. No.: 10/284,529

(22) Filed: Nov. 1, 2002

Related U.S. Application Data

(63) Continuation-in-part of application No. 10/158,447, filed on May 31, 2002, now Pat. No. 6,544,087.

(51) Int. Cl.[7] ..... B63H 16/04
(52) U.S. Cl. ..... 440/101
(58) Field of Search ..... 440/101; 416/69, 416/70 R

(56) References Cited

U.S. PATENT DOCUMENTS 4,820,216 A * 4/1989 Masters ..... 440/101
6,022,255 A * 2/2000 Lukanovich ..... 440/101

* cited by examiner

*Primary Examiner*—Ed Swinehart

(57) ABSTRACT

A fixing structure of a paddle has an outer tube, an inner tube and a tightening means. The tightening means is formed by a positioning ring and an engaging portion. One end portion of the positioning ring is protruded with an eccentric buckle, and one end of the buckle is protruded with an elastomer. An interior of the engaging portion has an eccentric embedding hole and an inner edge of the embedding hole is formed with a stepped edge for resisting against a buckle piece of the positioning ring. The annular side of the position ring is formed with irregular buckling textures; the buckling textures are a plurality of small particles so that the position ring substantially resists against an inner side of the outer tub; thereby, the outer tube tightly resists against the positioning ring.

3 Claims, 7 Drawing Sheets

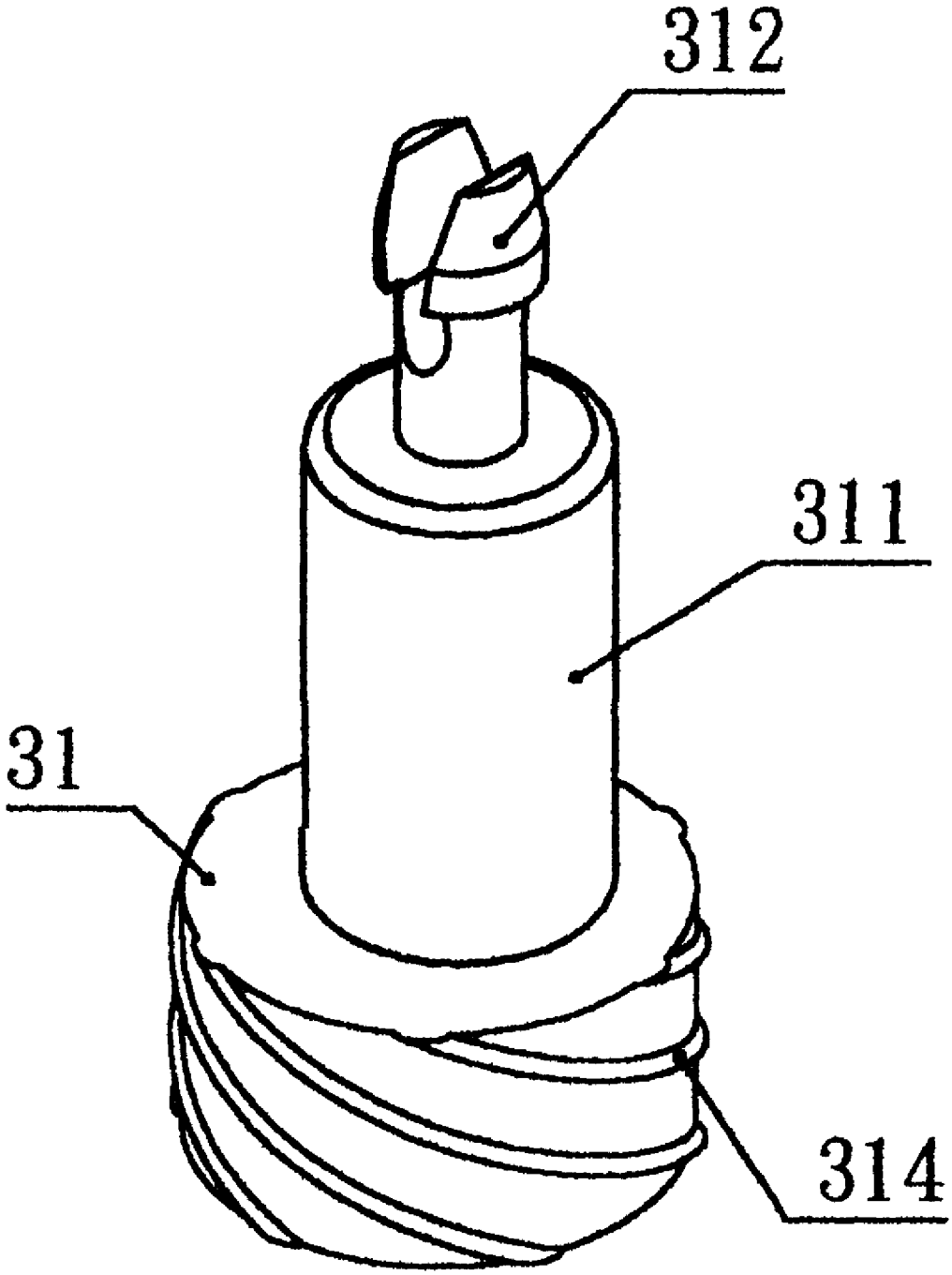
FIG2-A

FIG4-A

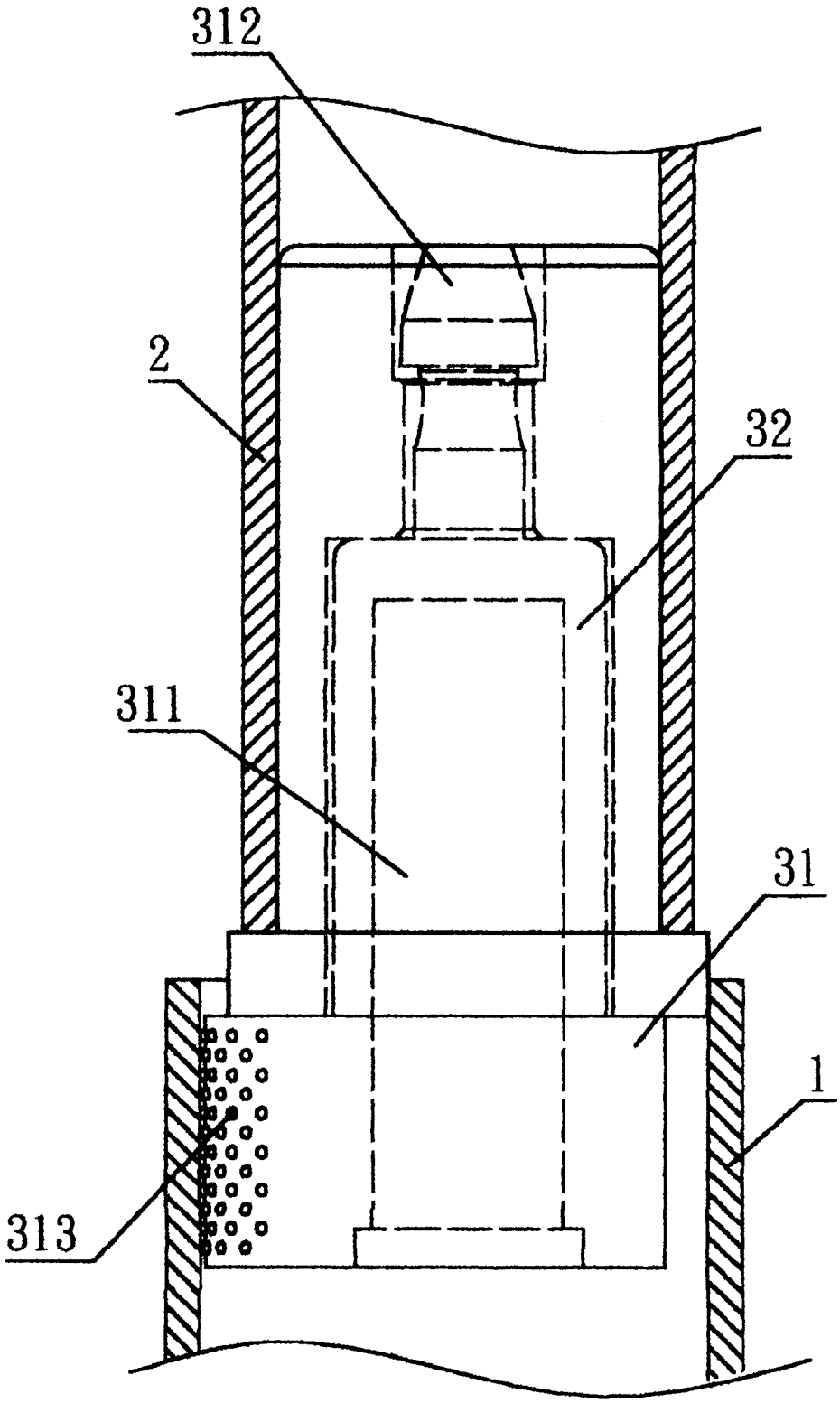
FIG5-A

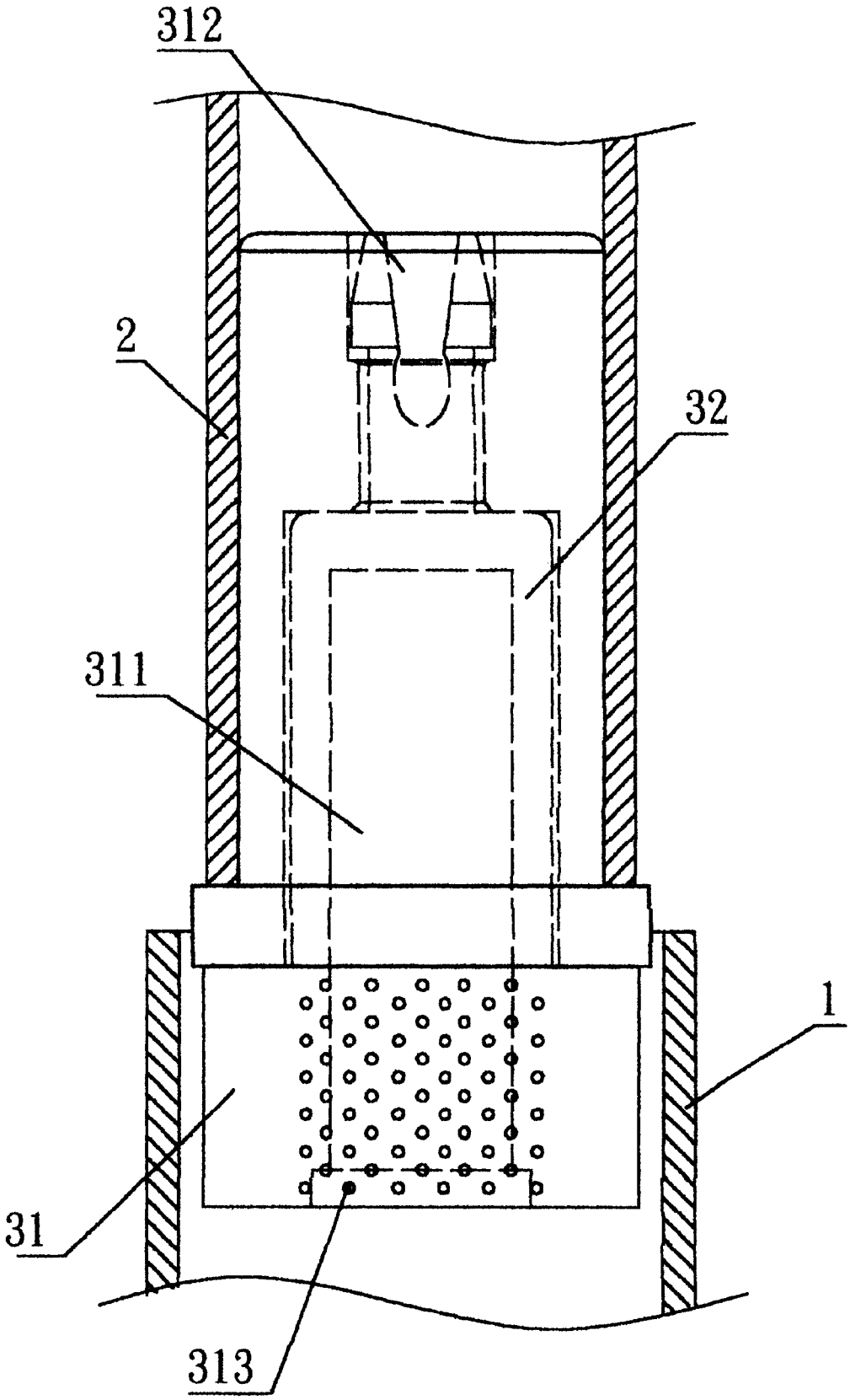
FIG5-B

FIXING STRUCTURE OF PADDLE

The present invention of a Continuation In Part (CIP) of U.S. patent application with Ser. No. 10/158,447, filing date May 31, 2001, U.S, Pat. No. 6,544,087 "Adjustable Fixing Structure of Paddle for Adjusting Length of Padded", which is now incorporated into the present invention, as a part of the specification.

FIELD OF THE INVENTION

The present invention relates to paddles, and particularly to a fixing structure of a paddle.

BACKGROUND OF THE INVENTION

With reference to FIG. 1, a prior art structure with U.S. Ser. No. 10/158447, "ADJUSTABLE FIXING STRUCTURE OF PADDLE FOR ADJUSTING LENGTH OF PADDLE", is clearly shown. The prior art paddle has an outer tube 1, an inner tube 2 and a tightening means 3 for tightening the outer tube 1 and outer tube 2.

The tightening means 3 is formed by a positioning ring 31 at one end portion of the outer tube 1 and an engaging portion 32 at one end portion of the inner tube 2. The positioning ring 31 is buckled to the engaging portion 32.

One end portion of the positioning ring 31 is protruded with an eccentric buckle 311, and one end of the buckle 311 is protruded with an elastomer 312. The elastomer 312 can be pushed and pulled so that the elastomer 312 can be engaged in an eccentric embedded hole 322 of the engaging portion 32.

An interior of the engaging portion 32 has a stepped through hole. One small end of the through hole is the eccentric embedded hole 322 and the inner side of the embedded hole 322 has an edge 323 for resisting against the elastomer 312 of the positioning ring 31.

The eccentric buckle 311 of the positioning ring 31 is inserted into a through hole of the engaging portion 32. The elastomer 312 of the positioning ring 31 is exactly inserted into the eccentric embedded hole 322 of the engaging portion 32. Thereby, when the engaging portion 32 rotates, the engaging portion 32 will separate from a center of the positioning ring 31 gradually due to eccentricity so that a center of the engaging portion 32 will not align with a center of the positioning ring 31, thereby, the lateral side of the engaging portion 32 will apply a force to the lateral side of the positioning ring 31 Thus, the outer tube 1 and inner tube 2 are tightly coupled with one another.

In above mentioned prior art structure, the buckle 311 of the positioning ring 31 is eccentric to the engaging portion 32 so that the diameter expands gradually. Thereby, the positioning ring resists against the outer tube. However, since the plastic products have smooth surface. Thus the surface of the positioning ring contacts the surface of the outer tube. Thereby, if an improper force is applied, the positioning ring is released from the outer tube. Thus, it is imperfect in the prior art.

SUMMARY OF THE INVENTION

Accordingly, the primary object of the present invention is to provide a A fixing structure of a paddle having an outer tube, an inner tube and a tightening means for tightening the outer tube and inner tube; the tightening means; the tightening means being formed by a positioning ring at one end portion of the outer tube and an engaging portion at one end portion of the inner tube; the positioning ring being buckled to the engaging portion; one end portion of the positioning ring is protruded with an eccentric buckle, and one end of the buckle is protruded with an elastomer; the elastomer is pushed and pulled so that the elastomer is engaged in an eccentric embedded hole of the engaging portion; an interior of the engaging portion has an eccentric embedding hole and an inner edge of the embedding hole is formed with a stepped edge for resisting against an buckle piece of the positioning ring; when the engaging portion rotates, a part of circular edge of the position ring will protrude out of the circular edge of the engaging portion so that the diameter thereof will expand to tightly resist against the outer tube; characterized in that: the annular side of the position ring is formed with irregular buckling textures; the buckling textures are a plurality of small particles so that the position ring substantially resists against an inner side of the outer tub; thereby, the outer tube tightly resists against the positioning ring.

The various objects and advantages of the present invention will be more readily understood from the following detailed description when read in conjunction with the appended drawing.

BRIEF DESCRIPTION OF THE DRAWINGS

FIG. 2A shows another embodiment of the positioning ring of the present invention.

FIG. 4A is a partial enlarged view of the present invention.

FIG. 5A shows one embodiment that the present invention is in a tightening state.

FIG. 5B shows one embodiment that the present invention is in a loose state.

DETAILED DESCRIPTION OF THE PREFERRED EMBODIMENTS

Figure 1:
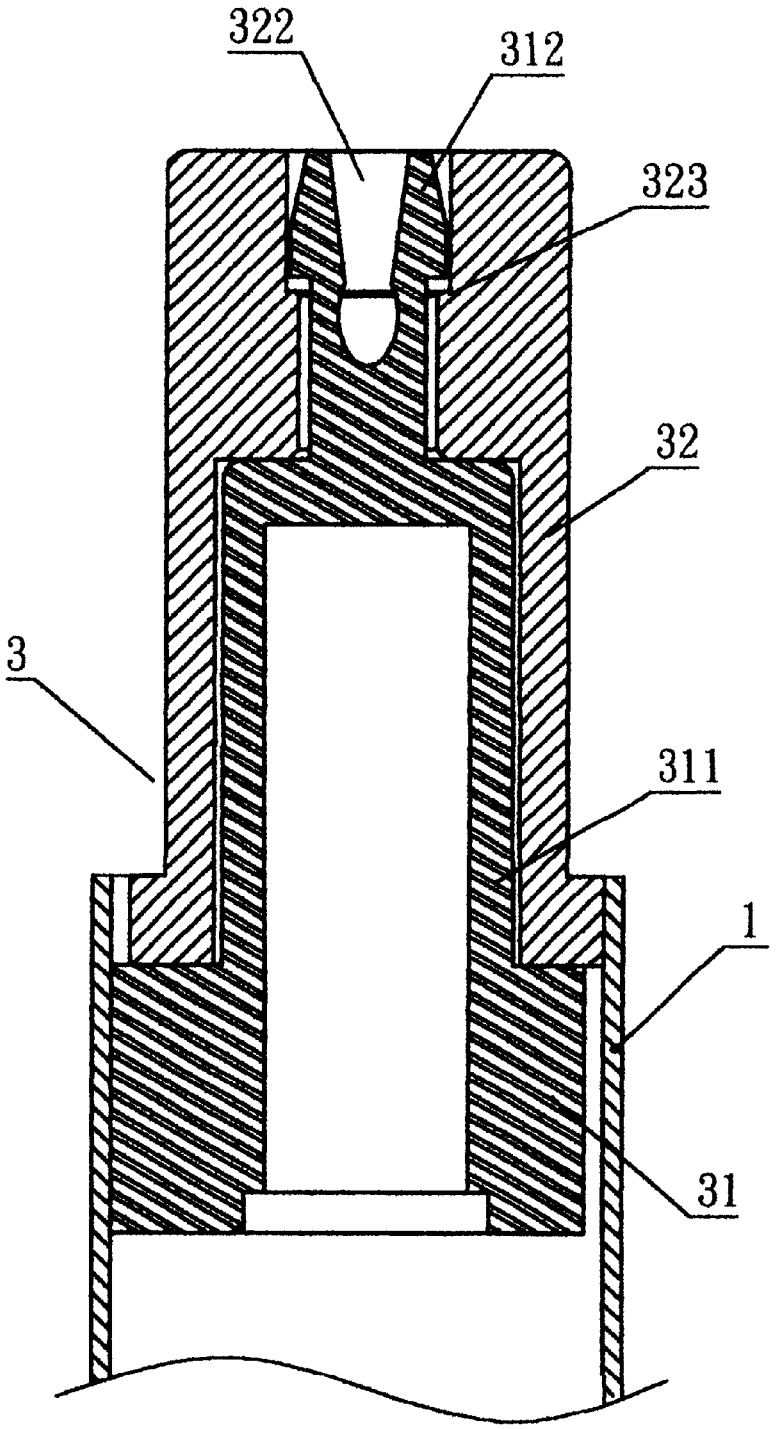
FIG1 PRIOR ART
FIG. 1 is an assembled plane view of a prior art.
Figure 2:
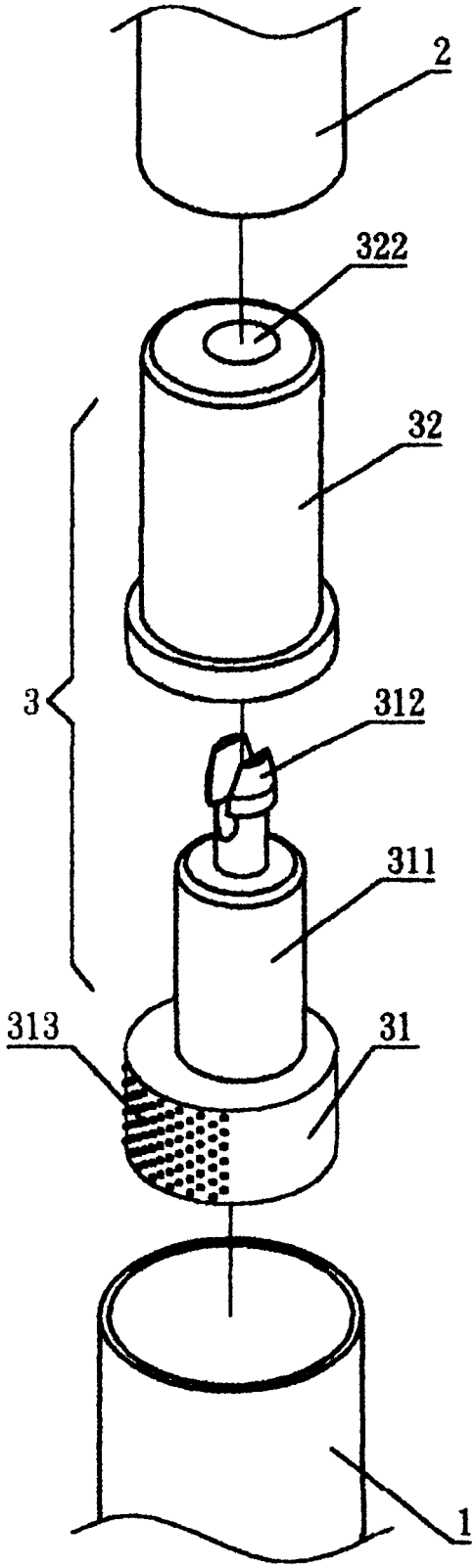
FIG. 2 is an exploded perspective view of the present invention.
Figure 3:
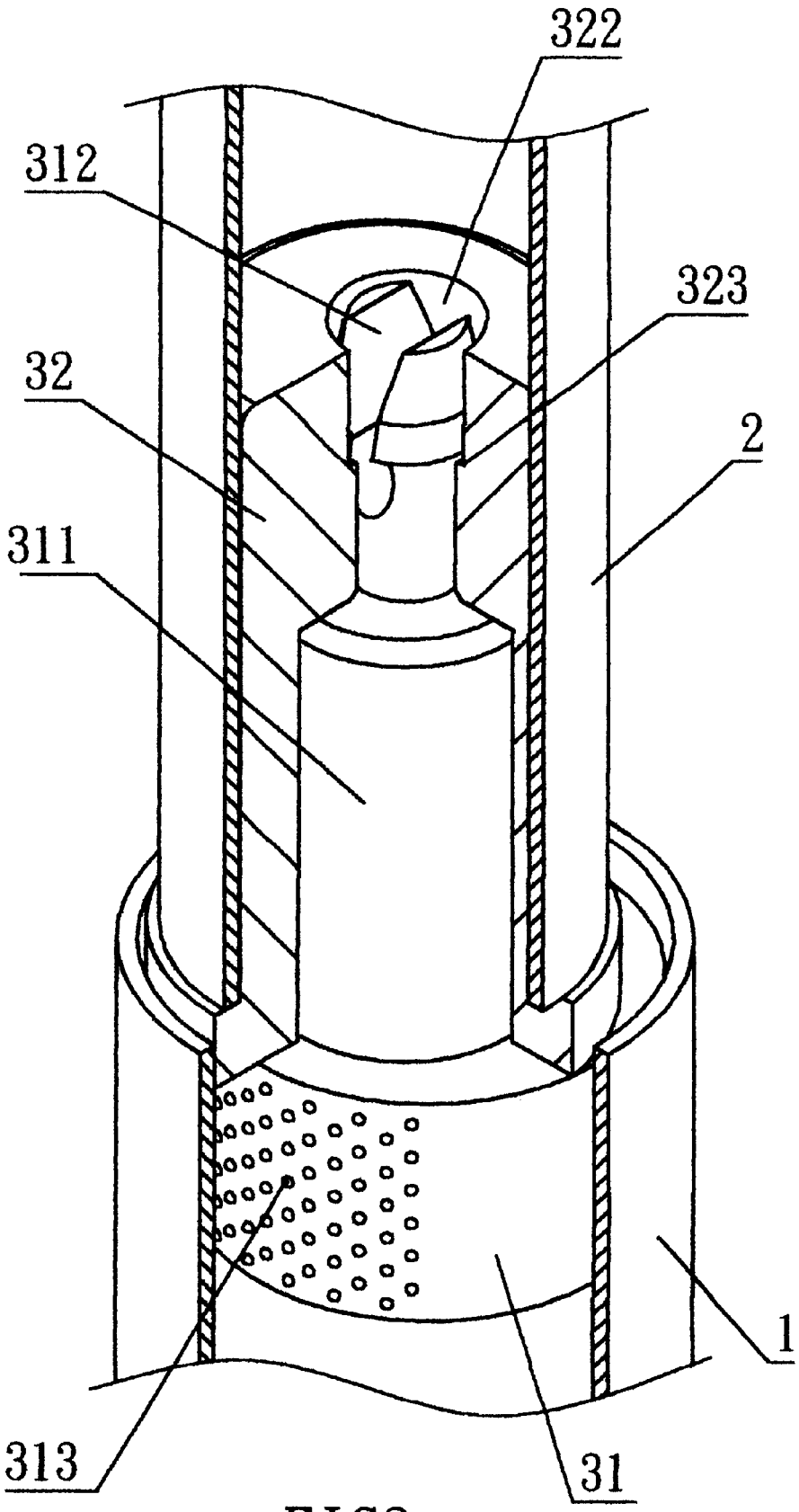
FIG. 3 is a cross sectional perspective view of the present invention.
Figure 4:
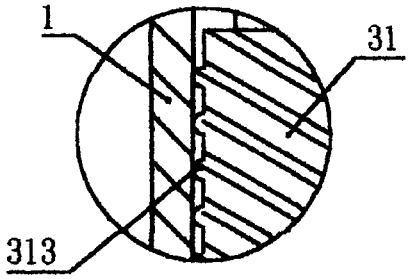
FIG. 4 is a plane cross section view of the present invention.
Figure 4:
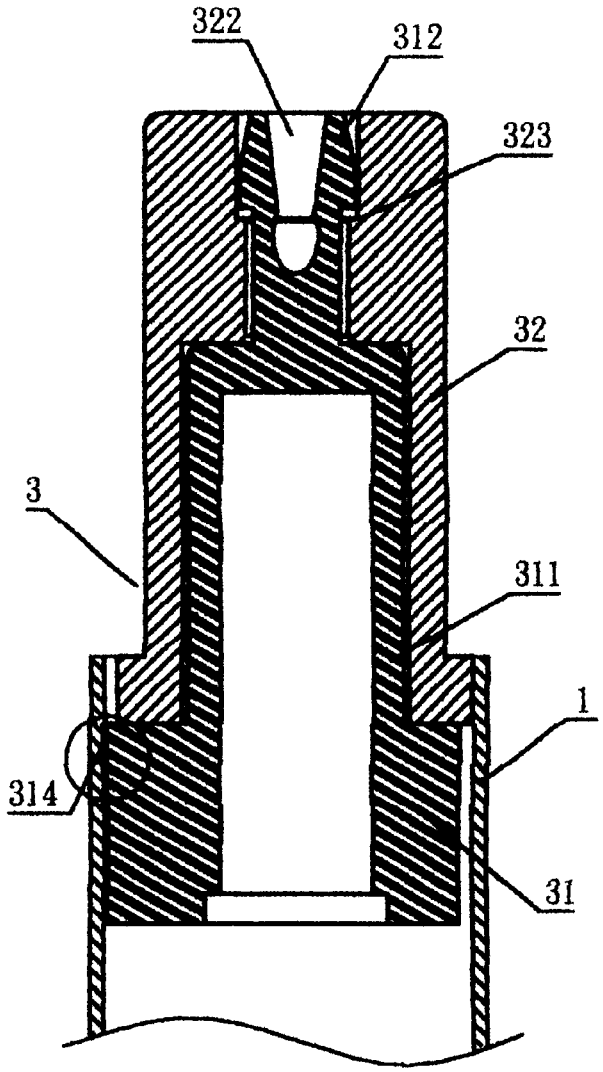

With reference to FIGS. 2 to 4, the structure of the present invention is clearly shown. The present invention has an outer tube 1, an inner tube 2 and a tightening means 3 for tightening the outer tube 1 and inner tube 2.

The tightening means 3 is formed by a positioning ring 31 at one end portion of the outer tube 1 and an engaging portion 32 at one end portion of the inner tube 2. The positioning ring 31 is buckled to the engaging portion 32.

One end portion of the positioning ring 31 is protruded with an eccentric buckle 311, and one end of the buckle 311 is protruded with an elastomer 312. The elastomer 312 can be pushed and pulled so that the elastomer 312 can be engaged in an eccentric embedded hole 322 of the engaging portion 32.

An interior of the engaging portion 32 has an eccentric embedding hole 322 and an inner edge of the embedding hole 322 is formed with a stepped edge 323 for resisting against an buckle piece 321 of the positioning ring 31. When the engaging portion 32 rotates, since the engaging portion 32 is eccentric to the position ring 31. When the inner tube 2 rotates with a direction reverse to the rotate direction of the outer tube 1, a part of circular edge of the position ring 31 will protrude out of the circular edge of the engaging portion 32 so that the diameter thereof will expand to tightly resist against the outer tube 1.

The feature of the present invention will be described herein. The annular side of the position ring 31 is formed with irregular buckling texture. The buckling texture can be a plurality of small particles 313 so that the position ring 31 can substantially resist against an inner side of the outer tube 1.

In another embodiment, the buckling texture can be protruded screw threads 314. Thereby, when the positioning ring 1 is engaged with the outer tube 1, it can tightly resist there against (referring to FIG. 2A).

The assembly and operation of the present invention will be described here, referring to FIGS. 4 and 5, the positioning ring 31 and the engaging portion 32 are secured to end portions of the outer tube 1 and inner tube 2. Then the positioning ring 31 is inserted into the engaging portion 32 so that the elastomer 312 can be successfully inserted into the embedding hole 322 of the engaging portion 32 so as to exactly resist against the stepped edge 323 (referring to FIG. 4).

When the positioning ring 31 and the engaging portion 32 are engaged successfully, an outer edge of the outer tube 1 has a section which can be engaged with the inner tube 2 so that the outer tube 1 and the inner tube 2 will move slightly with respect to one another. When the inner tube 2 rotates alone a reverse direction with respect to the outer tube 1, since the buckle 311 of the positioning ring 31 is eccentric to the embedding hole 322 of the engaging portion 32 so that the engaging portion 32 moves away from a center of the positioning ring 31. Then part of the positioning ring 31 will protrude out of the circular edge of the engaging portion 32 so as to expand the diameter thereof so as to tightly resist against the outer tube 1. The annular outer side of the positioning ring 31 are formed with buckling textures (313 or 314) so that the positioning ring 31 will further tightly resist against an inner wall of the outer tube 1. Thereby, the inner tube 2 tightly resists against and is positioned to the outer tube (referring to FIG. 5A).

When it is desired to adjust the length of the paddle, the outer tube 1 rotates with respect to the inner tube 2 along a reverse direction so that the engaging portion 32 moves to be coaxial with the position ring 31 so that the edge of the engaging portion 32 is coupled to the edge of the positioning ring 31. Therefore, the positioning ring 31 dose not tightly resist against the outer tube 1 (referring to FIG. 5B). Thereby, after the outer tube 1 and the inner tube 2 are adjusted to a proper length, they are tightly engaged and positioned.

By the feature of the buckling texture (313 or 314) of the positioning ring 31, and the outer tube 1 is embedded with the inner tube 2, they are not separated from one another.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A fixing structure of a paddle having an outer tube, an inner tube and a tightening means for tightening the outer tube and inner tube; the tightening means being formed by a positioning ring at one end portion of the outer tube and an engaging portion at one end portion of the inner tube; the positioning ring being buckled to the engaging portion;

one end portion of the positioning ring is protruded with an eccentric buckle, and one end of the buckle is protruded with an elastomer; the elastomer is pushed and pulled so that the elastomer is engaged in an eccentric embedded hole of the engaging portion;

an interior of the engaging portion has an eccentric embedding hole and an inner edge of the embedding hole is formed with a stepped edge for resisting against an buckle piece of the positioning ring; when the engaging portion rotates, a part of circular edge of the position ring will protrude out of the circular edge of the engaging portion so that the diameter thereof will expand to tightly resist against the outer tube; characterized in that:

the annular side of the position ring is formed with irregular buckling textures; the buckling textures are a plurality of small particles so that the position ring substantially resists against an inner side of the outer tub; thereby, the outer tube tightly resists.

2. The fixing structure of a paddle as claim in claim 1, wherein the buckling textures are protruding particles.

3. The fixing structure of a paddle as claim in claim 1, wherein the buckling textures are protruding textures.

* * * * *